US010712104B2

(12) United States Patent
Maeda et al.

(10) Patent No.: US 10,712,104 B2
(45) Date of Patent: Jul. 14, 2020

(54) HEAT EXCHANGER AND REFRIGERATION CYCLE APPARATUS

(71) Applicant: Mitsubishi Electric Corporation, Tokyo (JP)

(72) Inventors: Tsuyoshi Maeda, Tokyo (JP); Akira Yatsuyanagi, Tokyo (JP); Shin Nakamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 17 days.

(21) Appl. No.: 16/095,769

(22) PCT Filed: Jul. 1, 2016

(86) PCT No.: PCT/JP2016/069707
§ 371 (c)(1),
(2) Date: Oct. 23, 2018

(87) PCT Pub. No.: WO2018/003123
PCT Pub. Date: Jan. 4, 2018

(65) Prior Publication Data

US 2019/0383567 A1 Dec. 19, 2019

(51) Int. Cl.
*F28F 17/00* (2006.01)
*F28F 1/32* (2006.01)
(Continued)

(52) U.S. Cl.
CPC ..... *F28F 17/005* (2013.01); *F25B 39/00* (2013.01); *F28F 1/325* (2013.01); *F25B 39/02* (2013.01);
(Continued)

(58) Field of Classification Search
CPC .. F28F 2265/14; F28F 2215/12; F28F 17/005; F28F 1/32; F28F 2215/08;
(Continued)

(56) References Cited

U.S. PATENT DOCUMENTS

2013/0299153 A1 11/2013 Jindon et al.
2015/0068244 A1* 3/2015 Lee ..... F28F 17/005 62/498

FOREIGN PATENT DOCUMENTS

JP S58-180 U 1/1983
JP H07-091873 A 4/1995
(Continued)

OTHER PUBLICATIONS

Office Action dated Jul. 30, 2019 issued in corresponding JP patent application No. 2018-524709 (and English translation).
(Continued)

*Primary Examiner* — Ana M Vazquez
(74) *Attorney, Agent, or Firm* — Posz Law Group, PLC

(57) ABSTRACT

A heat exchanger according to an embodiment of the invention includes a fin extending in the gravity direction and heat transfer pipes installed so as to intersect the fin. The heat transfer pipes are arranged in the gravity direction. The fin has a water guiding area disposed above and below each of the heat transfer pipes, and a water drainage area disposed adjacent to a side of each of the heat transfer pipes. The water guiding area has water guiding structures for guiding water to the water drainage area. The water drainage area has water drainage structures for guiding water in the gravity direction.

8 Claims, 11 Drawing Sheets

(51) Int. Cl.
*F25B 39/00* (2006.01)
*F25B 39/02* (2006.01)

(52) U.S. Cl.
CPC ..... *F28F 2215/12* (2013.01); *F28F 2265/22* (2013.01)

(58) Field of Classification Search
CPC ..... F28D 1/05391; F28D 1/05383; F28D 2021/0064; F25B 39/02
See application file for complete search history.

(56) References Cited

FOREIGN PATENT DOCUMENTS

| | | | |
|---|---|---|---|
| JP | 2004-036938 | A | 2/2004 |
| JP | 2012-037154 | A | 2/2012 |
| JP | 2012-163317 | A | 8/2012 |
| JP | 2014-035122 | A | 2/2014 |

OTHER PUBLICATIONS

International Search Report of the International Searching Authority dated Oct. 4, 2016 for the corresponding international application No. PCT/JP2016/069707 (and English translation).

* cited by examiner

HEAT EXCHANGER AND REFRIGERATION CYCLE APPARATUS

CROSS REFERENCE TO RELATED APPLICATION

This application is a U.S. national stage application of PCT/JP2016/069707 filed on Jul. 1, 2016, the contents of which are incorporated herein by reference.

TECHNICAL FIELD

The present invention relates to a finned tube heat exchanger and a refrigeration cycle apparatus equipped with the heat exchanger.

BACKGROUND ART

Known finned tube heat exchangers include plate-shaped fins arranged at a predetermined fin interval and heat transfer pipes (hereinafter referred to as "flat pipes") that have a flat shape having a larger width than height. Such finned tube heat exchangers including flat pipes are hereinafter referred to as "flat pipe heat exchangers".

Compared with heat exchangers including circular pipes, a typical flat pipe heat exchanger can ensure a large area of heat transfer of the pipes and reduce the ventilation resistance of heat exchange fluid and thus provide improved heat transfer performance. In contrast, if the flat pipe heat exchanger is used as an evaporator, its drainage performance is inferior to that of the heat exchangers including circular pipes because water drops readily remain on the surfaces (flat surfaces) of the flat pipes due to their shape profile.

For example, if the flat pipe heat exchanger is used as a heat-source-side heat exchanger installed in an outdoor unit of an air-conditioning apparatus (exemplary refrigeration cycle apparatus), the water in the air (heat exchange fluid) condenses and forms frost on the heat-source-side heat exchanger during a heating operation. The frost formation leads to an increase in the ventilation resistance, impairment in the heat transfer performance, and damage to the heat exchanger. To avoid these problems, a typical air-conditioning apparatus has a defrosting operation mode. Undesirably, if water drops remain in the heat-source-side heat exchanger, the water drops refreeze and form a larger volume of frost. That is, the heat-source-side heat exchanger having low drainage performance requires a longer period of defrosting operation, resulting in impairment in comfortability and a reduction in average heating capacity.

To solve these problems, heat exchangers designed to improve the drainage performance have been developed (for example, refer to Patent Literature 1). Patent Literature 1 discloses "a fin-and-tube type heat exchanger comprising vertical flat-plate fins having notches and flat pipes inserted into side surfaces of the fins, wherein the flat pipes are inserted from a downstream side of an air flow, and the notches are provided in the fins such that sections of the flat pipes are angled upward with respect to the air flow."

CITATION LIST

Patent Literature

Patent Literature 1: Japanese Unexamined Patent Application Publication No. 7-91873

SUMMARY OF INVENTION

Technical Problem

In the heat exchanger disclosed in Patent Literature 1, the flat pipes are angled with respect to the air flow to cause condensed water drops remaining on the upper surfaces of the flat pipes to be readily drained off by gravity. The heat exchanger disclosed in Patent Literature 1 can thus suppress water dripping and reduce the defrosting period. To sufficiently bring about such effects, the flat pipes are required to be angled at a large angle. If the flat pipes are angled at a large angle, however, air that has entered the heat exchanger separates unintentionally at the front edges of the flat pipes, thereby impairing the heat transfer performance, which is an advantage of the flat pipes.

In contrast, in the case of a small inclination angle, condensed water drops readily remain on the upper and lower surfaces of the flat pipes. If the water drops remaining on the upper and lower surfaces of the flat pipes are not sufficiently drained off, the water drops may cause corrosion of the fins and pipes. Such corrosion of the fins and pipes results in an impairment in the reliability of the heat exchanger.

An object of the invention, which has been accomplished to solve the above problems, is to provide a heat exchanger that has both excellent drainage performance and sufficient heat transfer performance and to provide a refrigeration cycle apparatus equipped with the heat exchanger.

Solution to Problem

A heat exchanger according to an embodiment of the invention includes a fin extending in the gravity direction and heat transfer pipes installed so as to intersect the fin. The heat transfer pipes are arranged in the gravity direction. The fin has a water guiding area disposed above and below each of the heat transfer pipes, and a water drainage area disposed adjacent to a side of each of the heat transfer pipes. The water guiding area has water guiding structures for guiding water to the water drainage area. The water drainage area has water drainage structures for guiding water in the gravity direction.

A refrigeration cycle apparatus according to another embodiment of the invention is equipped with a refrigerant circuit including a compressor, a first heat exchanger, an expansion device, and a second heat exchanger connected to each other with a refrigerant pipe. At least one of the first heat exchanger and the second heat exchanger is composed of the above-described heat exchanger.

Advantageous Effects of Invention

In the heat exchanger according to the one embodiment of the invention, the water guiding area of the fin has water guiding structures for guiding water to the water drainage area, while the water drainage area of the fin has water drainage structures for guiding water in the gravity direction. This configuration can cause water adhering to the fin to readily flow downward from the water drainage area, thus improving the drainage performance. The configuration can also suppress air passages from being blocked by frozen water, for example, thus ensuring sufficient heat transfer performance.

The refrigeration cycle apparatus according to the other embodiment of the invention is equipped with the above-described heat exchanger and can thus provide significantly improved performance of draining off water drops generated in the heat exchanger, thereby ensuring sufficient heat transfer performance.

DESCRIPTION OF EMBODIMENTS

Figure 1:
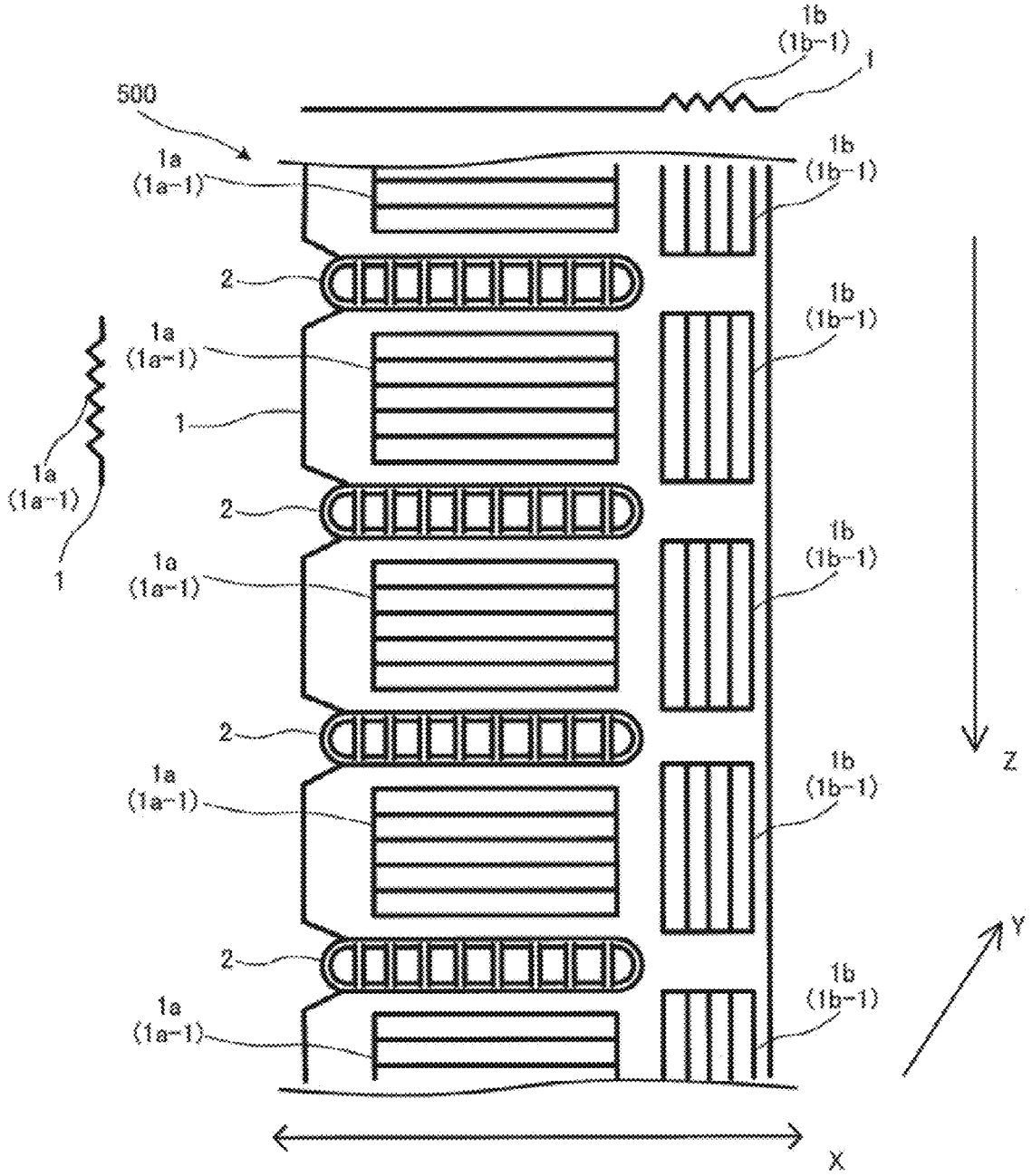
FIG. 1 is a schematic sectional view of a part of an exemplary configuration of a finned tube heat exchanger according to Embodiment 1 of the invention.

Embodiments of the invention will now be described while referring to the accompanying drawings as required. In these drawings including FIG. 1, the illustrated size relationships between the components may differ from the actual size relationships. The components provided with the same reference symbol in the drawings including FIG. 1 are identical or correspond to each other throughout the specification. The modes of the components described in the entire specification are mere examples and should not be construed as limiting the scope of the invention.

Embodiment 1

Figure 2:
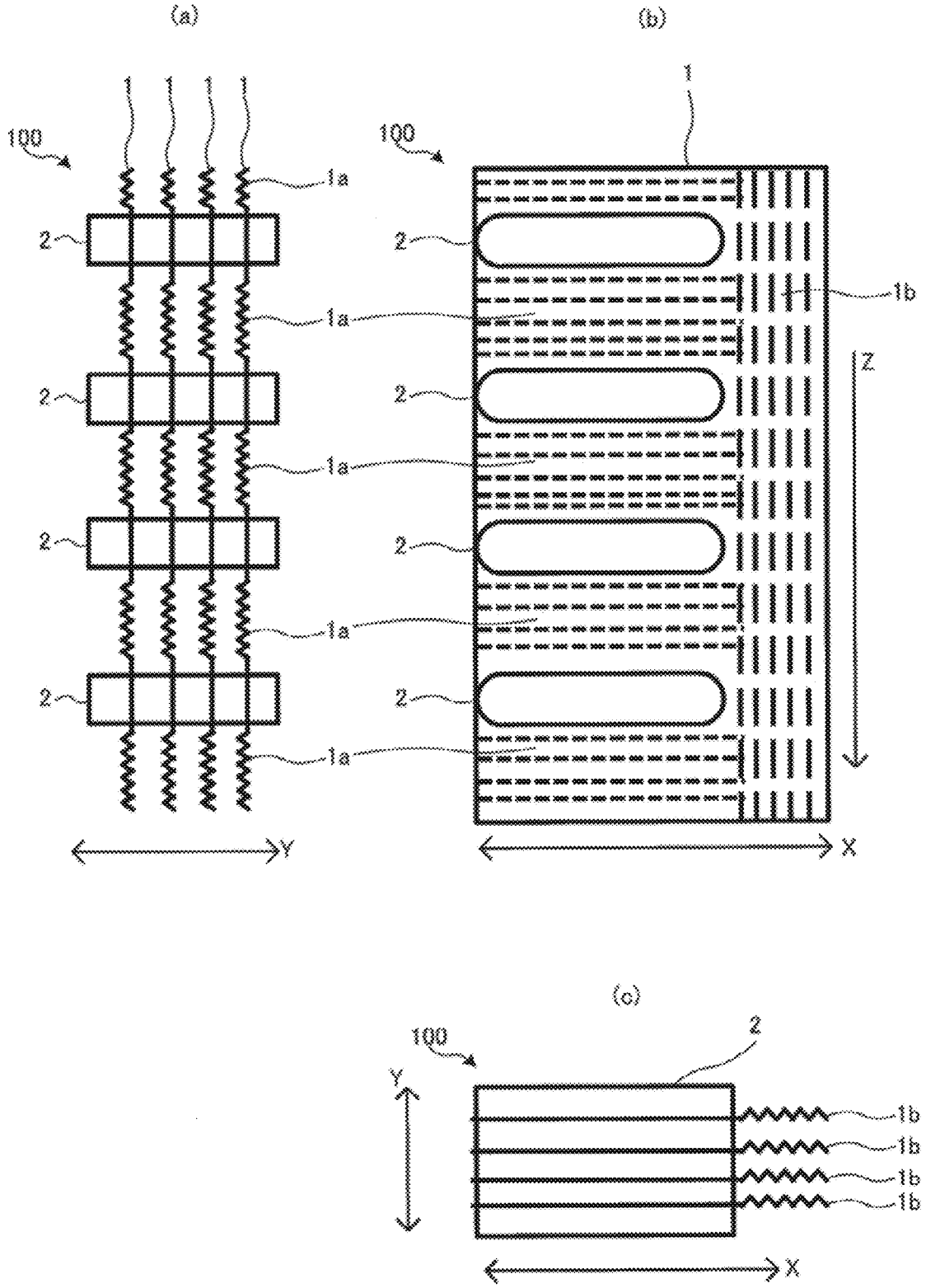
FIG. 2 are schematic diagrams of a part of an exemplary configuration of the finned tube heat exchanger according to Embodiment 1 of the invention as viewed in three directions.
Figure 3:
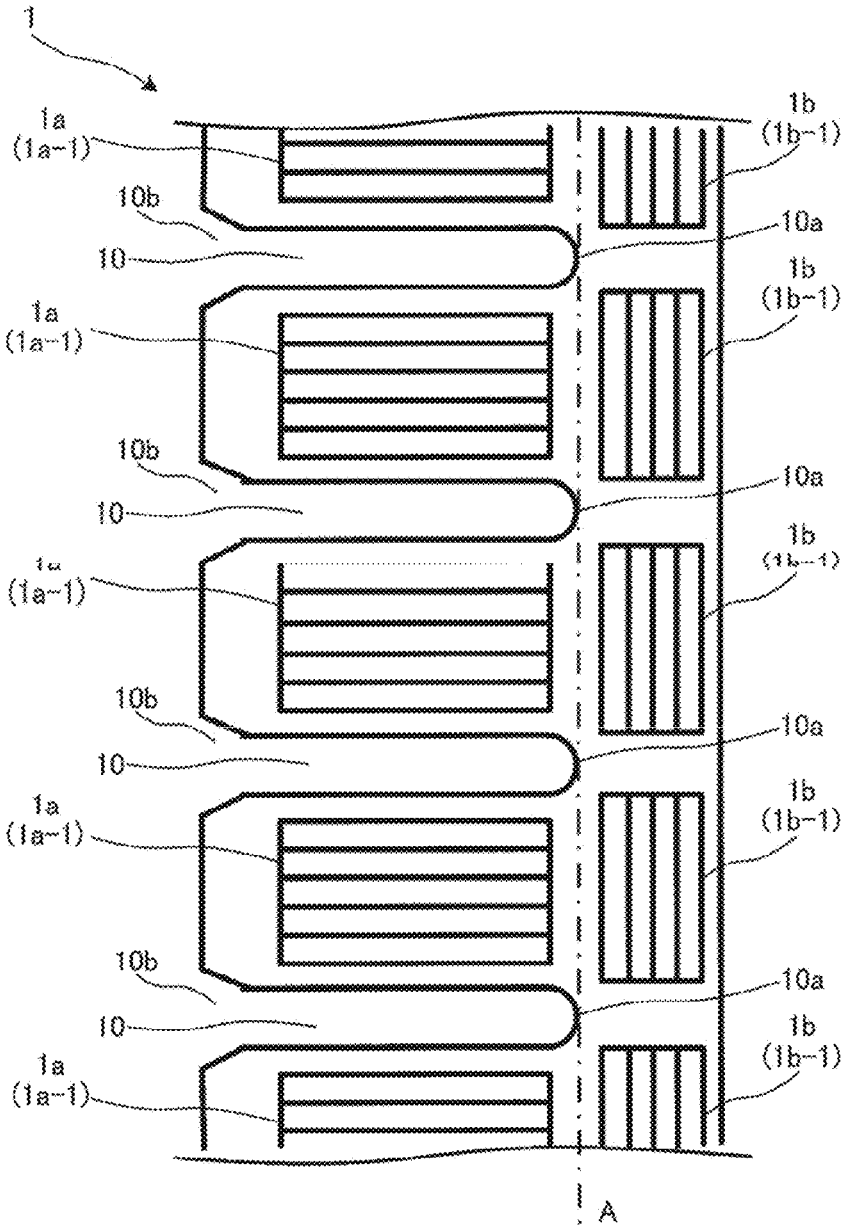
FIG. 3 is a schematic side view of an exemplary configuration of a fin included in the finned tube heat exchanger according to Embodiment 1 of the invention.
Figure 4:
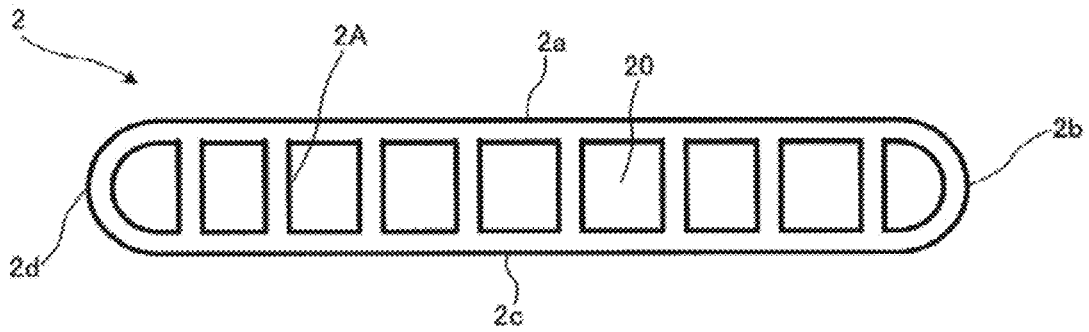
FIG. 4 is a schematic sectional view of an exemplary configuration of a heat transfer pipe included in the finned tube heat exchanger according to Embodiment 1 of the invention.
Figure 5:
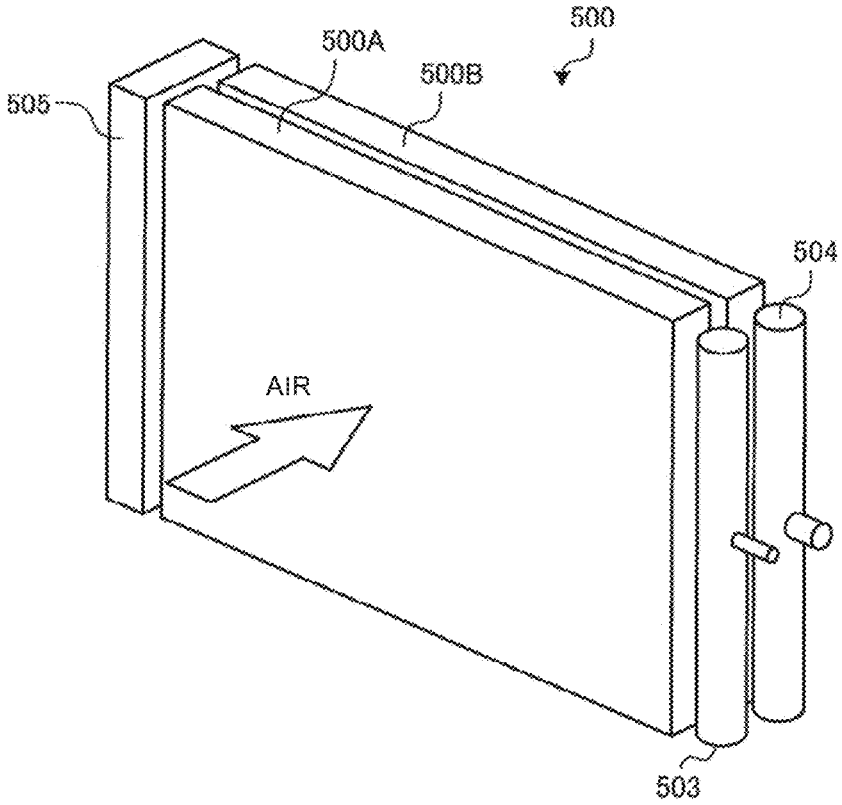
FIG. 5 is a schematic perspective view of an exemplary external configuration of the finned tube heat exchanger according to Embodiment 1 of the invention.

FIG. 1 is a schematic sectional view of a part of an exemplary configuration of a finned tube heat exchanger (hereinafter referred to as "heat exchanger 500") according to Embodiment 1 of the invention. FIG. 2 illustrates schematic diagrams of a part of an exemplary configuration of the heat exchanger 500 as viewed in three directions. FIG. 3 is a schematic side view of an exemplary configuration of a fin 1 included in the heat exchanger 500. FIG. 4 is a schematic sectional view of an exemplary configuration of a heat transfer pipe 2 included in the heat exchanger 500. FIG. 5 is a schematic perspective view of an exemplary external configuration of the heat exchanger 500. The heat exchanger 500 will now be described with reference to FIGS. 1 to 5.

In FIGS. 1 and 2, arrow X indicates the air flow direction, arrow Y indicates the array direction of the fins 1, and arrow Z indicates the gravity direction. FIGS. 1 and 2 are enlarged views of a region in which four heat transfer pipes 2 are inserted into the fin 1. FIG. 1 also includes schematic diagrams of the fin 1 as viewed from the top and the side. In FIG. 2, part (a) illustrates a side of the heat exchanger 500 as viewed in the air flow direction, part (b) illustrates a side of the heat exchanger 500 as viewed in the direction in which the heat transfer pipes 2 extend, and part (c) illustrates the top of the heat exchanger 500 as viewed from above. In FIG. 5, the blank arrow indicates the air flow.

The heat exchanger 500 includes plate-shaped fins 1, which are arranged at a predetermined interval such that a fluid (for example, air) flows between the fins 1, and heat transfer pipes 2 inserted into the fins 1 in the axial direction. Each of the fins 1 is composed of a plate-shaped member that extends such that the longitudinal direction matches the gravity direction. The fins 1 are arranged at a predetermined fin interval Fp in the direction (direction indicated by arrow Y) orthogonal to the air flow direction and to the gravity direction. The heat transfer pipes 2 extend across the fins 1 in the direction indicated by arrow Y. The fins 1 and the heat transfer pipes 2 are tightly integrated with each other by brazing.

(Schematic Configuration of Fin 1)

Each of the fins 1 has a water guiding area 1*a* disposed above and below the heat transfer pipes 2 and a water drainage area 1*b* disposed adjacent to the sides of the heat transfer pipes 2.

Specifically, the water guiding area 1*a* is an area which is provided with notches 10 arranged in the longitudinal direction of the fin 1, which corresponds to the gravity direction. The inserted heat transfer pipes 2 are tightly bonded to the water guiding area 1*a*. The water guiding area 1*a* guides water (for example, condensed water drops) adhering to a region between the vertically adjacent heat transfer pipes 2 to the water drainage area 1*b*.

The water drainage area 1*b* is an area which is not provided with notches 10 arranged in the longitudinal direction of the fin 1, which corresponds to the gravity direction. The water drainage area 1*b* guides water adhering to the fin 1 (including the water guided from the water guiding area 1*a*) in the gravity direction.

Each of the notches 10 provided on the fin 1 is formed by cutting out the fin 1 from first side (the left of FIG. 3) to the vicinity of second side (the right of FIG. 3) and has a shape corresponding to the external diameter of the heat transfer pipe 2. The end of the notch 10 adjacent to the second side is called an innermost end 10*a*, and the end of the notch 10 adjacent to the first side is called an insertion part 10*b*. The innermost end 10*a* has a fillet shape, as illustrated in FIG. 3. It should be noted that the innermost end 10*a* may have another shape, such as an elliptical shape, other than the fillet shape. In other words, the innermost end 10*a* is only required to have a shape corresponding to the profile of the heat transfer pipe 2. The straight line (dashed and single-dotted line A in FIG. 3) that passes through the tips of the innermost ends 10*a* in the gravity direction serves as the boundary between the water guiding area 1*a* and the water drainage area 1*b*.

The insertion part 10*b* flares in the direction from the second side to the first side of the fin 1. This shape of the insertion part 10*b* facilitates insertion of the heat transfer pipe 2 into the notch 10.

The distance between the vertically adjacent notches 10 in the gravity direction is determined to be a certain vertical interval Dp.

The fin 1 is composed of aluminum or an aluminum alloy, for example.

(Schematic Configuration of Heat Transfer Pipe 2)

The heat transfer pipes 2 are installed in the respective notches 10 of the fins 1 so as to intersect the fins 1. The heat transfer pipes 2 are installed in the notches 10 of the fins 1 and are thus arranged in the gravity direction. Each of the heat transfer pipes 2 has a larger width (longitudinal axis in a sectional view) than height (transverse axis in a sectional view), as illustrated in FIG. 1. The heat transfer pipes 2 extend such that the longitudinal axes match the flow direction of fluid flowing between the fins 1 and are arranged at an interval in the vertical direction (the up-down direction in the figure) orthogonal to the flow direction.

In the following description, the longitudinal axis of the heat transfer pipe 2, that is, the side extending in the width direction of the fin 1, is also called the width of the heat transfer pipe 2. Although the description focuses on an example in which the heat transfer pipes 2 are composed of flat pipes, the heat transfer pipes 2 do not necessarily have a flat shape. The heat transfer pipes 2 are only required to have a larger width than height.

With reference to FIG. 4, the heat transfer pipe 2 has an upper surface 2*a* defining the top of the flat shape, a lower surface 2*c* defining the bottom of the flat shape, a first side 2*d* defining one end of the flat shape in the width direction (on the left of FIG. 4), and a second side 2*b* defining the other end of the flat shape in the width direction (on the right of FIG. 4). Although FIG. 4 illustrates the heat transfer pipe 2 having the upper surface 2*a* and the lower surface 2*c* disposed parallel to each other, the upper surface 2*a* or the lower surface 2*c* may be angled so that the upper surface 2*a* and the lower surface 2*c* are not parallel to each other.

Each of the first side 2*d* and the second side 2*b* has an arch shape, that is, a fillet shape in section. In the heat transfer pipe 2 installed in the notch 10 of the fin 1, the second side 2*b* adjoins the innermost end 10*a* of the notch 10 of the fin 1, while the first side 2*d* adjoins the insertion part 10*b* of the notch 10 of the fin 1.

The distance between the vertically adjacent heat transfer pipes 2 in the gravity direction is determined to be the certain vertical interval Dp.

The heat transfer pipe 2 is composed of aluminum or an aluminum alloy, for example.

The heat transfer pipe 2 has therein partitions 2A, which define refrigerant passages 20 inside the heat transfer pipe 2. The surfaces of the partitions 2A and the inner surfaces of the heat transfer pipe 2 may have grooves or slits. This structure increases the area of contact with refrigerant flowing in the refrigerant passages 20 and thus improves the efficiency of heat exchange.

The heat transfer pipe 2 is fabricated such that the upper surface 2*a* and the lower surface 2*c* are substantially symmetrical about the vertical line that passes through the center in the width direction. This shape can readily ensure the manufacturability in extrusion molding of the heat transfer pipe 2.

The heat transfer pipe 2 may be fabricated by, for example, extrusion molding to have an elliptical sectional shape and then transformed into a final shape by an additional process.

(First Specific Configuration of Fin 1)

Figure 6:
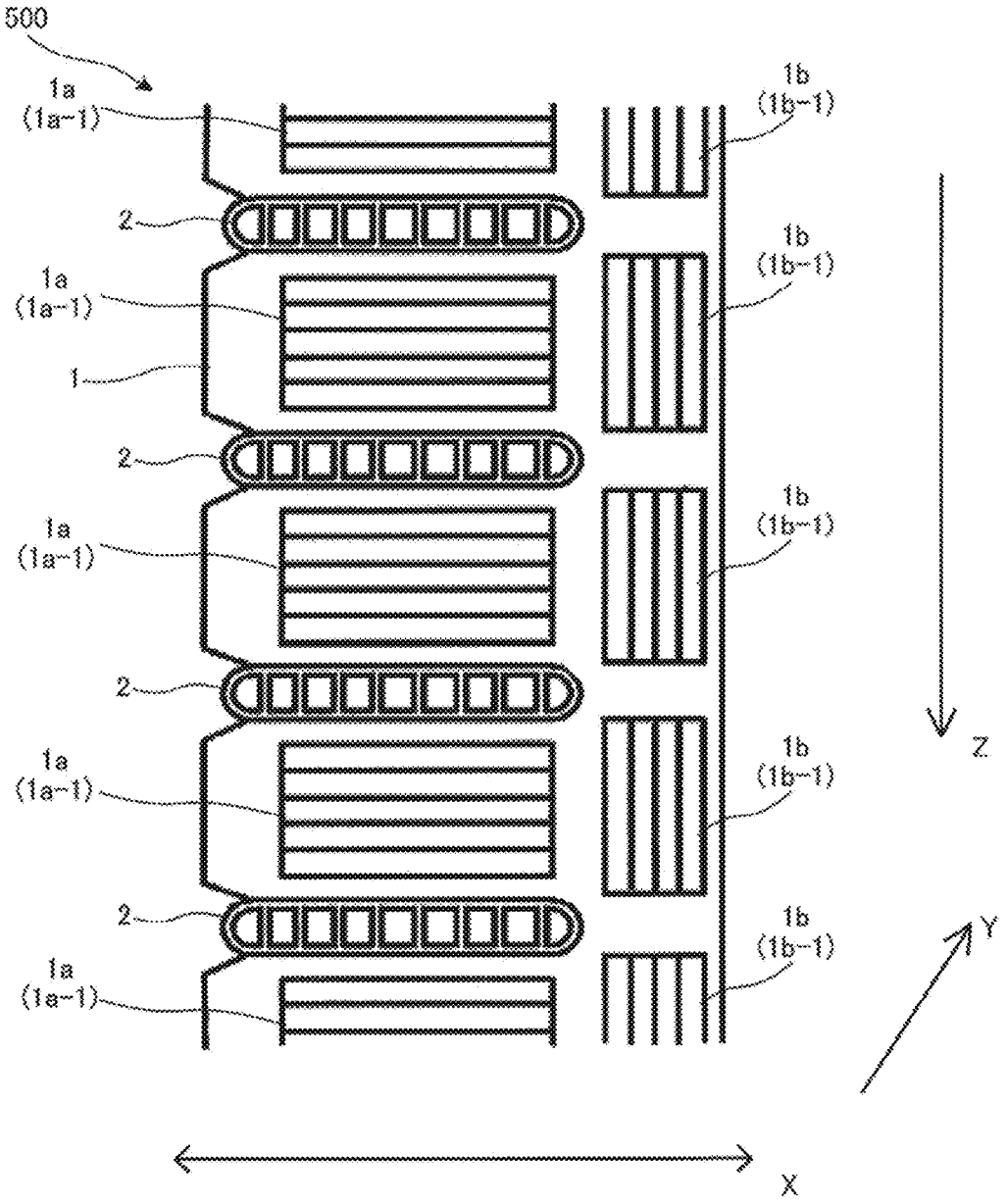
FIG. 6 illustrates one example of specific configurations of the fin included in the finned tube heat exchanger according to Embodiment 1 of the invention.

FIG. 6 illustrates one example of specific configurations of the fin 1 included in the heat exchanger 500. This example of the specific configurations of the fin 1 will now be described in detail with reference to FIGS. 1, 2, and 6. In FIG. 6, arrow X indicates the air flow direction, arrow Y indicates the array direction of the fins 1, and arrow Z indicates the gravity direction. FIG. 6 is an enlarged view of a region in which four heat transfer pipes 2 are inserted into a fin 1.

The fin 1 has a water guiding area 1*a* and a water drainage area 1*b*, as illustrated in FIGS. 1, 2, and 6. The fin 1 has water guiding structures that are formed in at least part of the water guiding area 1*a* and that guide water to the water drainage area 1*b*. The fin 1 also has water drainage structures that are formed in at least part of the water drainage area 1*b* and that drain off water in the gravity direction.

Water Guiding Structures

The water guiding structures are formed in at least part of the water guiding area 1*a*. Specifically, the water guiding structures are formed by corrugating part of the component constituting the fin 1 to provide ridge lines in the X-axis direction. These water guiding structures having a corrugated shape are hereinafter referred to as "corrugated water guiding structures 1*a*-1". The water guiding area 1*a* having the corrugated water guiding structures 1*a*-1 can cause water adhering to the water guiding area 1*a* to flow along the ridge lines of the corrugated water guiding structures 1*a*-1 and thus readily guide the water to the water drainage area 1*b*. This configuration can improve the drainage performance of the heat exchanger 500.

The number of corrugations of the corrugated water guiding structures 1*a*-1 is not particularly limited. The ridges and valleys of the corrugations of the corrugated water guiding structures 1*a*-1 may be formed by bending at a certain angle or bending into curved shapes. In addition, the ridge lines of the corrugations of the corrugated water guiding structures 1*a*-1 are not necessarily exactly in the X-axis direction and may be angled with respect to the X-axis direction. If the ridge lines of the corrugations of the corrugated water guiding structures 1*a*-1 are angled downward toward the water drainage area 1*b*, the corrugated water guiding structures 1*a*-1 can more readily guide water to the water drainage area 1*b* (refer to FIG. 9).

Water Drainage Structures

The water drainage structures are formed in at least part of the water drainage area 1*b*. Specifically, the water drainage structures are formed by corrugating part of the member constituting the fin 1 to provide ridge lines in the Z-axis direction. These water drainage structures having a corrugated shape are hereinafter referred to as "corrugated water drainage structures 1*b*-1". The water drainage area 1*b* having the corrugated water drainage structures 1*b*-1 can cause water adhering to the water drainage area 1*b* (including the water guided from the water guiding area 1*a*) to flow along the ridge lines of the corrugated water drainage structures 1*b*-1 and thus readily drain off the water to the lower portion of the heat exchanger 500. This configuration can improve the drainage performance of the heat exchanger 500.

The number of corrugations of the corrugated water drainage structures 1*b*-1 is not particularly limited. The ridges and valleys of the corrugations of the corrugated water drainage structures 1*b*-1 may be formed by bending at a certain angle or bending into curved shapes. FIGS. 1 and 6 illustrate an example in which the corrugated water drainage structures 1*b*-1 are separated from each other at the portions corresponding to the notches 10. Alternatively, all the corrugated water drainage structures 1*b*-1 may be continuous, as illustrated in FIG. 2.

Although FIGS. 1 and 6 illustrate an example in which the corrugated water guiding structures 1*a*-1 are separated from the corrugated water drainage structures 1*b*-1, this example should not be construed as limiting the scope of the invention. Alternatively, the corrugated water guiding structures 1*a*-1 and the corrugated water drainage structures 1*b*-1 may be continuous, as illustrated in FIG. 2. In the case where the corrugated water guiding structures 1*a*-1 are separated from the corrugated water drainage structures 1*b*-1, the distance therebetween is not particularly limited.

The fin 1 may also have slits provided by cutting and raising portions of the fin 1. The slits can reduce the resistance resulting from heat transfer and thus facilitate heat transfer between the fin 1 and air flowing in the air passages between the fins 1. In the case of providing the slits, the positions of the slits are not particularly limited. For example, the slits may be formed in at least part of the water guiding area 1*a* (that is, the corrugated water guiding structures 1*a*-1), may be formed in at least part of the water drainage area 1*b* (that is, the corrugated water drainage structures 1*b*-1), or may be formed in at least part of both the water guiding area 1*a* and the water drainage area 1*b*.

(Second Specific Configuration of Fin 1)

Figure 7:
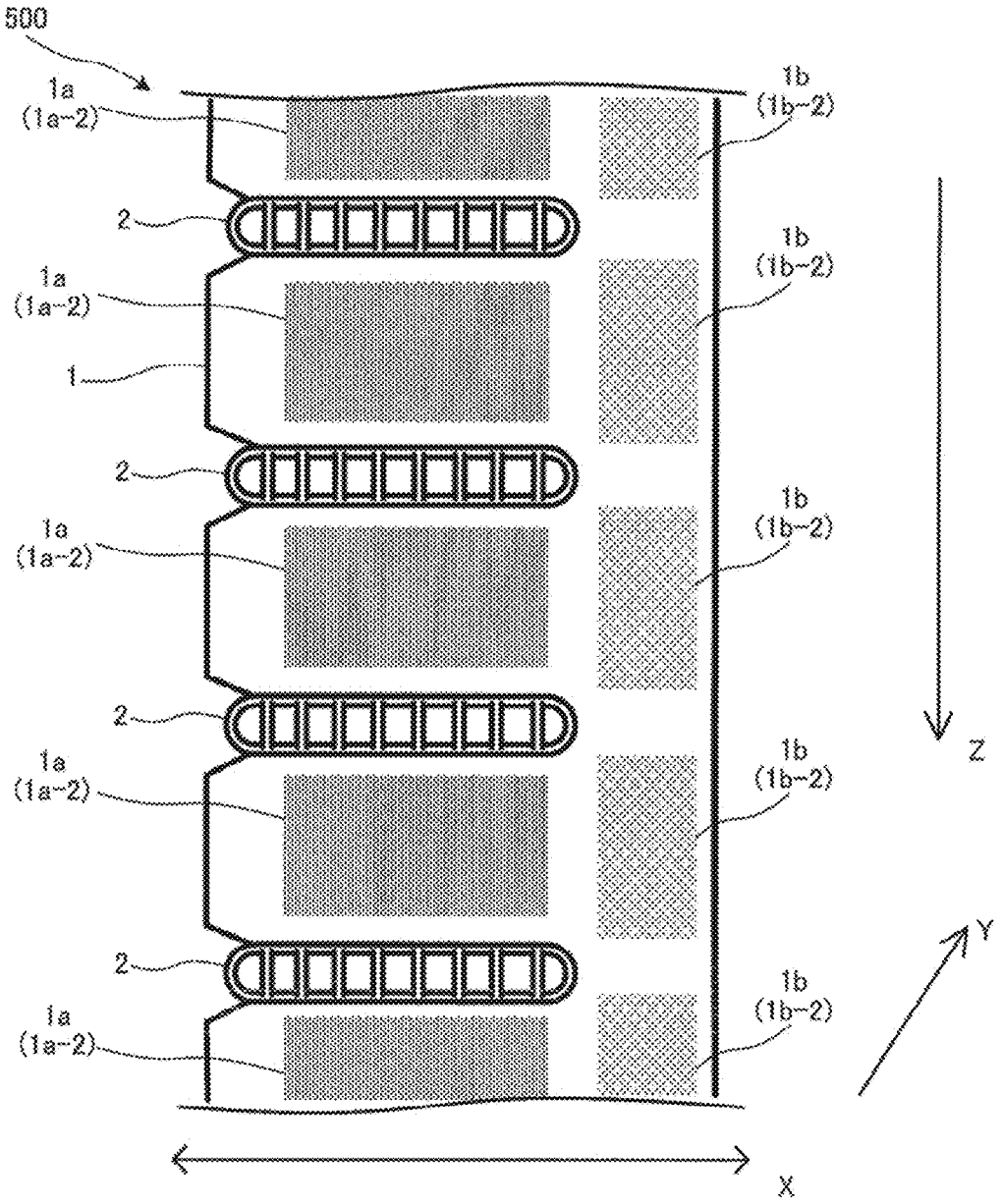
FIG. 7 illustrates still another example of specific configurations of the fin included in the finned tube heat exchanger according to Embodiment 1 of the invention.

FIG. 7 illustrates another example of specific configurations of the fin 1 included in the heat exchanger 500. This example of the specific configurations of the fin 1 will now be described in detail with reference to FIG. 7. In FIG. 7, arrow X indicates the air flow direction, arrow Y indicates the array direction of the fins 1, and arrow Z indicates the gravity direction. FIG. 7 is an enlarged view of a region in which four heat transfer pipes 2 are inserted into a fin 1.

Water Guiding Structures

The water guiding structures may be formed by forming a part of the member constituting the fin 1 in dimples, as illustrated in FIG. 7. These water guiding structures having dimples are hereinafter referred to as "dimpled water guiding structures 1*a*-2". The water guiding area 1*a* having the dimpled water guiding structures 1*a*-2 can readily guide water adhering to the water guiding area 1*a* to the water drainage area 1*b* because of the surface tension generated by the dimples. This configuration can improve the drainage performance of the heat exchanger 500.

The number of dimples of the dimpled water guiding structures 1*a*-2 is not particularly limited. The depth of the dimples and the interval among the dimples of the dimpled water guiding structures 1*a*-2 are not particularly limited. The tops of the dimples of the dimpled water guiding structures 1*a*-2 may be formed by bending at a certain angle or bending into curved shapes as R parts. The individual dimples of the dimpled water guiding structures 1*a*-2 do not necessarily have a uniform size. All or some of the dimples may have different sizes.

Water Drainage Structures

The water drainage structures may be formed by forming a part of the component constituting the fin 1 in dimples, as illustrated in FIG. 7. These water drainage structures having dimples are hereinafter referred to as "dimpled water drainage structures 1*b*-2", The water drainage area 1*b* having the dimpled water drainage structures 1*b*-2 can cause water adhering to the water drainage area 1*b* (including the water guided from the water guiding area 1*a*) to flow in the gravity direction because of the surface tension generated by the dimples and thus readily drain off the water to the lower portion of the heat exchanger 500. This configuration can improve the drainage performance of the heat exchanger 500.

The number of dimples of the dimpled water drainage structures 1*b*-2 is not particularly limited. The depth of the dimples and the interval among the dimples of the dimpled water drainage structures 1*b*-2 are not particularly limited. The tops of the dimples of the dimpled water drainage structures 1*b*-2 may be formed by bending at a certain angle or bending into curved shapes as R parts. The individual dimples of the dimpled water drainage structures 1*b*-2 do not necessarily have a uniform size. All or some of the dimples may have different sizes.

The dimples of the dimpled water guiding structures 1*a*-2 and the dimples of the dimpled water drainage structures 1*b*-2 may be arranged at the same density or different densities. Causing a difference in density leads to adjustment of the surface tensions, thereby facilitating generation of a water flow from the water guiding area 1*a* to the water drainage area 1*b*. In other words, causing a difference in shape between the water guiding area 1*a* and the water drainage area 1*b* can facilitate generation of a water flow from the water guiding area 1*a* to the water drainage area 1*b*.

The densities can be varied by adjusting the interval among the dimples of the dimpled water guiding structures 1*a*-2 and the interval among the dimples of the dimpled water drainage structures 1*b*-2. Alternatively, the densities may be varied by adjusting the height of the dimples of the dimpled water guiding structures 1*a*-2 and the height of the dimples of the dimpled water drainage structures 1*b*-2. The height of the dimples indicates the height from fin 1 to the tops of the dimples when the fin 1 is assumed to be the bottom.

Although FIGS. 1 and 7 illustrate an example in which the dimpled water guiding structures 1*a*-2 are separated from the dimpled water drainage structures 1*b*-2, this example should not be construed as limiting the scope of the invention. Alternatively, the dimpled water guiding structures 1*a*-2 and the dimpled water drainage structures 1*b*-2 may be continuous. In the case where the dimpled water guiding structures 1*a*-2 are separated from the dimpled water drainage structures 1*b*-2, the distance therebetween is not particularly limited.

The fin 1 may also have slits provided by cutting and raising portions of the fin 1. The slits can facilitate heat transfer between the fin 1 and air flowing in the air passages between the fins 1, as described above. In the case of providing the slits, the positions of the slits are not particularly limited. For example, the slits may be formed in at least part of the water guiding area 1*a* (that is, the dimpled water guiding structures 1*a*-2), may be formed in at least part of the water drainage area 1*b* (that is, the dimpled water drainage structures 1*b*-2), or may be formed in at least part of both the water guiding area 1*a* and the water drainage area 1*b*.

(Third Specific Configuration of Fin 1)

Figure 8:
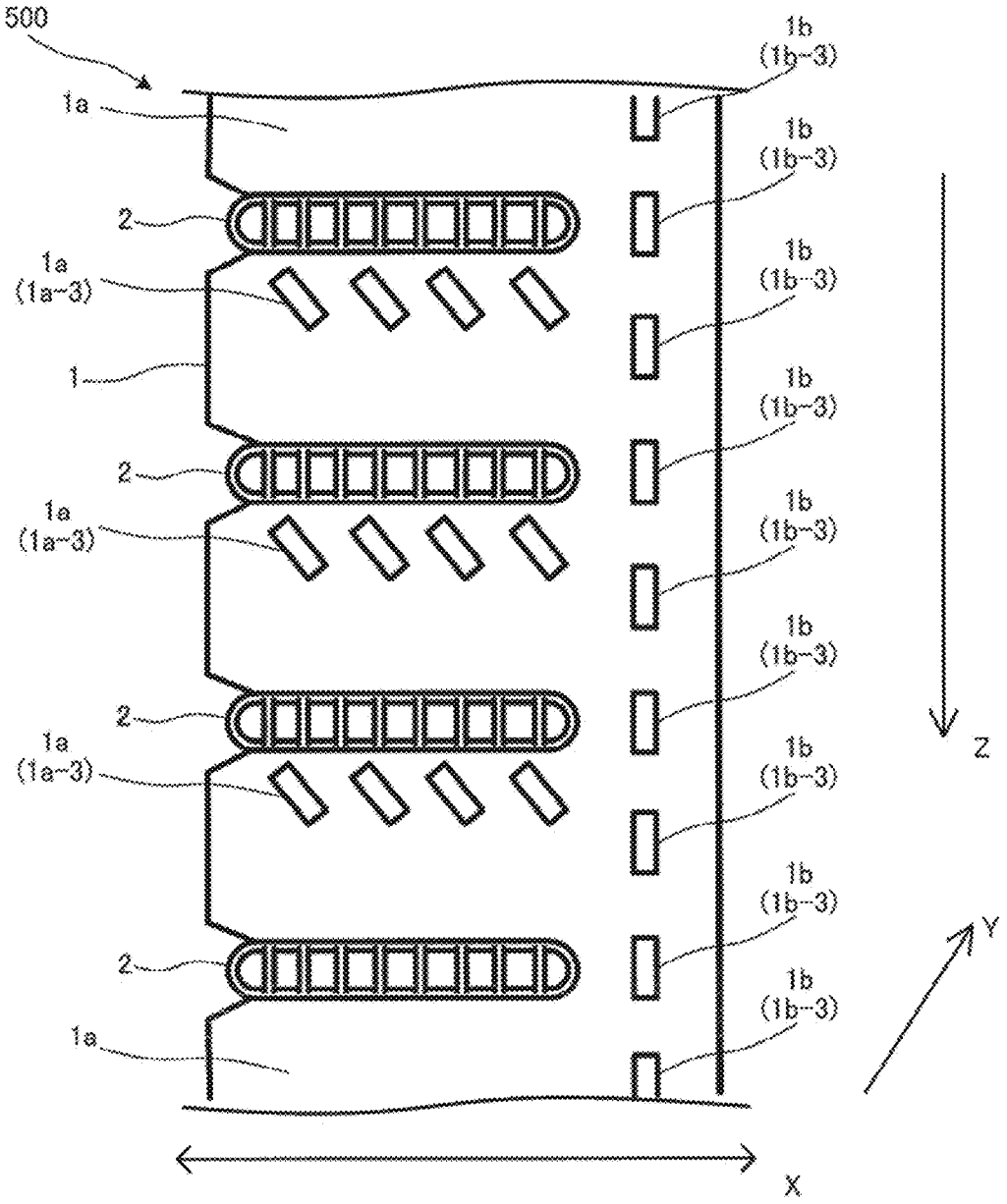
FIG. 8 illustrates still another example of specific configurations of the fin included in the finned tube heat exchanger according to Embodiment 1 of the invention.

FIG. 8 illustrates still another example of specific configurations of the fin 1 included in the heat exchanger 500. This example of the specific configurations of the fin 1 will now be described in detail with reference to FIG. 8. In FIG. 8, arrow X indicates the air flow direction, arrow Y indicates the array direction of the fins 1, and arrow Z indicates the gravity direction. FIG. 8 is an enlarged view of a region in which four heat transfer pipes 2 are inserted into a fin 1.

The water guiding structures may be formed by slitting a part of the member constituting the fin 1, as illustrated in FIG. 8. These water guiding structures having slits are hereinafter referred to as "slit water guiding structures 1*a*-3". The water guiding area 1*a* having the slit water guiding structures 1*a*-3 can readily guide water adhering to the water guiding area 1*a* to the water drainage area 1*b* because of the difference in shape. This configuration can improve the drainage performance of the heat exchanger 500.

The number of slits of the slit water guiding structures 1*a*-3 is not particularly limited. The sizes and shapes of the slits of the slit water guiding structures 1*a*-3 are not particularly limited. The individual slits of the slit water guiding structures 1*a*-3 do not necessarily have a uniform size. All or some of the slits may have different sizes. Although the slit water guiding structures 1*a*-3 are angled with respect to the X-axis direction in the illustrated example, this example should not be construed as limiting the scope of the invention. Alternatively, the slit water guiding structures 1*a*-3 may not be angled with respect to the X-axis direction.

Water Drainage Structures

The water drainage structures may be formed by slitting a part of the member constituting the fin 1, as illustrated in FIG. 8. These water drainage structures having slits are hereinafter referred to as "slit water drainage structures 1*b*-3". The water drainage area 1*b* having the slit water drainage structures 1*b*-3 can cause water adhering to the water drainage area 1*b* (including the water guided from the water guiding area 1*a*) to flow in the gravity direction because of the difference in shape and thus readily drain off the water to the lower portion of the heat exchanger 500. This configuration can improve the drainage performance of the heat exchanger 500.

The number of slits of the slit water drainage structures 1*b*-3 is not particularly limited. The sizes and shapes of the slits of the slit water drainage structures 1*b*-3 are not particularly limited. The individual slits of the slit water drainage structures 1*b*-3 do not necessarily have a uniform size. All or some of the slits may have different sizes.

(Fourth Specific Configuration of Fin 1)

The above description illustrates some specific exemplary combinations of water guiding structures and water drainage structures, specifically, a combination of the corrugated water guiding structures 1*a*-1 and the corrugated water drainage structures 1*b*-1, a combination of the dimpled water guiding structures 1*a*-2 and the dimpled water drainage structures 1*b*-2, and a combination of the slit water guiding structures 1*a*-3 and the slit water drainage structures 1*b*-3. These combinations may be appropriately modified. For example, a combination of the corrugated water guiding structures 1*a*-1 and the dimpled water drainage structures 1*b*-2 and a combination of the dimpled water guiding structures 1*a*-2 and the corrugated water drainage structures 1*b*-1 may be available. These combinations may be modified to include the slit water guiding structures 1*a*-3 or the slit water drainage structures 1*b*-3.

(Fifth Specific Configuration of Fin 1)

Figure 9:
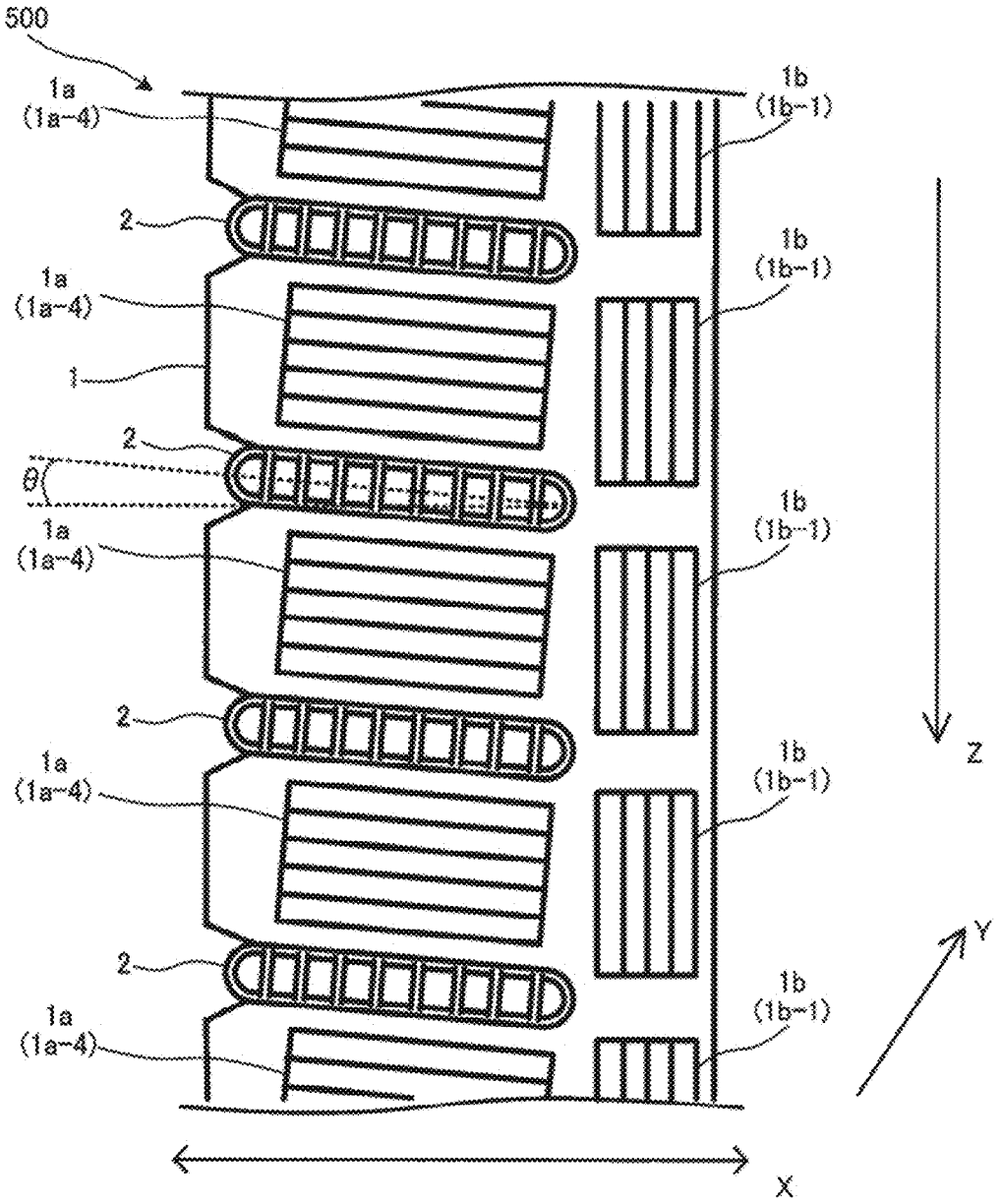
FIG. 9 illustrates still another example of specific configurations of the fin included in the finned tube heat exchanger according to Embodiment 1 of the invention.
Figure 10:
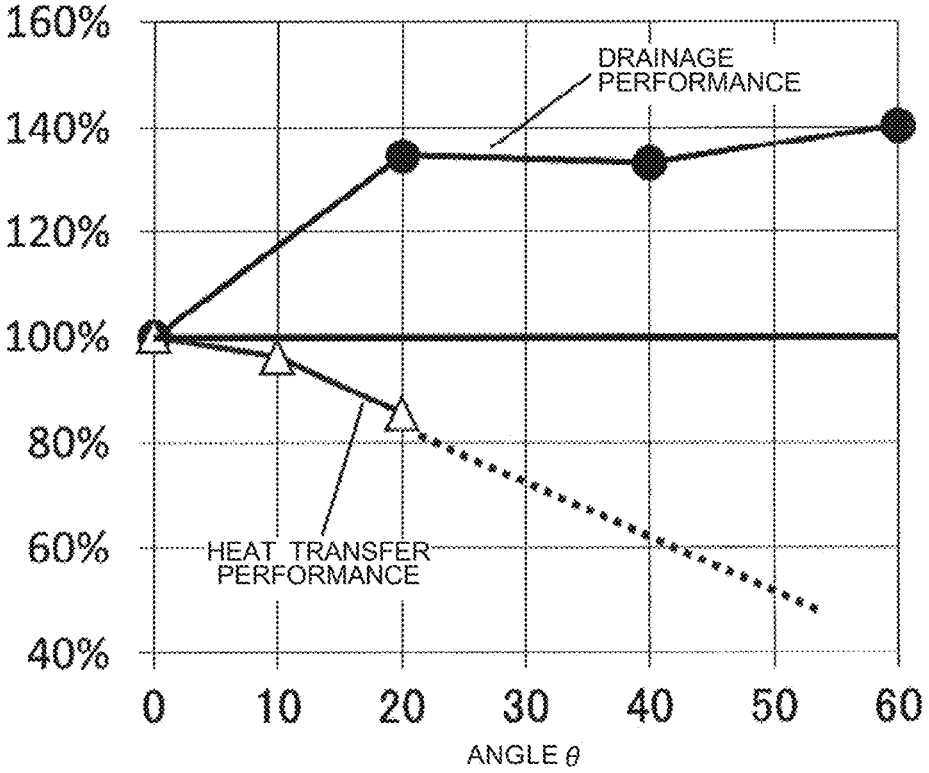
FIG. 10 illustrates the relationship between the angle of the heat transfer pipes and the performance of heat transfer and drainage of the finned tube heat exchanger according to Embodiment 1 of the invention.

FIG. 9 illustrates still another example of specific configurations of the fin 1 included in the heat exchanger 500. FIG. 10 illustrates the relationship between the angle θ of the heat transfer pipes 2 and the performance of heat transfer and drainage of the heat exchanger 500. This example of the specific configurations of the fin 1 will now be described in detail with reference to FIGS. 9 and 10. In FIG. 9, arrow X indicates the air flow direction, arrow Y indicates the array direction of the fins 1, and arrow Z indicates the gravity direction. FIG. 9 is an enlarged view of a region in which four heat transfer pipes 2 are inserted into a fin 1. In FIG. 10, the vertical axis indicates the performance of heat transfer and drainage, and the horizontal axis indicates the angle θ.

Although FIG. 6 illustrates an example in which the longitudinal axes of the notches 10 and the ridge lines of the corrugated water guiding structures 1*a*-1 extend in the X-axis direction, FIG. 9 illustrates an example in which the longitudinal axes of the notches 10 and the ridge lines of the corrugated water guiding structures 1*a*-1 are angled with respect to the X-axis direction. Specifically, the heat transfer pipes 2 are provided to the fins 1 such that the longitudinal axes are angled downward toward the water drainage area 1*b*. This configuration can cause water remaining on the upper surfaces 2*a* of the heat transfer pipes 2 and water adhering to the corrugated water guiding structures 1*a*-1 to more readily flow to the water drainage area 1*b*, thereby further improving the drainage performance. It should be noted that the corrugated water guiding structures that are angled are illustrated as "diagonal corrugated water guiding structures 1*a*-4" in FIG. 9.

FIG. 10 demonstrates that the drainage performance rapidly increases in the range of angle θ of 0 to 20 degrees but tends to be stable at or above 20 degrees without a significant increase. This graph also demonstrates that the heat transfer performance decreases with an increase in the angle θ. The cause of this phenomenon seems to be that an increase in the angle θ results in a reduction in the distance between the vertically adjacent heat transfer pipes 2, thereby increasing the ventilation resistance of an air flow. Accordingly, the angle θ should preferably be 20° or less with respect to the X-axis direction.

Not all of the longitudinal axes of the notches 10 and the ridge lines of the diagonal corrugated water guiding structures 1*a*-4 are necessarily angled with respect to the X-axis direction. It is only required that at least some of the longitudinal axes of the notches 10 and the ridge lines of the diagonal corrugated water guiding structures 1*a*-4 are angled with respect to the X-axis direction. Alternatively, at least the longitudinal axes of the notches 10 or the ridge lines of the diagonal corrugated water guiding structures 1*a*-4 may be angled with respect to the X-axis direction.

Although the explanation was made taking as an example the diagonal corrugated water guiding structures 1*a*-4, the dimpled water guiding structures 1*a*-2 and the slit water guiding structures 1*a*-3 may also be angled in the same manner.

(Schematic Configuration of Heat Exchanger 500)

The heat exchanger 500 includes two units each including the fins 1 illustrated in FIG. 3 and the heat transfer pipes 2 illustrated in FIG. 4, for example. The two units are arranged adjacent to each other with a gap therebetween in the direction parallel to the flow direction of fluid. As illustrated in FIG. 5, the two units, each including the fins 1 illustrated in FIG. 3 and the heat transfer pipes 2 illustrated in FIG. 4, are arranged adjacent to each other as a windward heat exchanger unit 500A and a leeward heat exchanger unit 500B to configure the heat exchanger 500. That is, the windward heat exchanger unit 500A and the leeward heat exchanger unit 500B have the same configuration including the fins 1 illustrated in FIG. 3 and the heat transfer pipes 2 illustrated in FIG. 4.

Alternatively, the two units, each including the fins 1 illustrated in any one of FIGS. 6 to 9 and the heat transfer pipes 2 illustrated in FIG. 4, may be arranged adjacent to each other as the windward heat exchanger unit 500A and the leeward heat exchanger unit 500B to configure the heat exchanger 500, as illustrated in FIG. 5. Alternatively, the windward heat exchanger unit 500A may include the fins 1 illustrated in FIG. 7 and the heat transfer pipes 2 illustrated in FIG. 4, while the leeward heat exchanger unit 500B may include the fins 1 illustrated in FIG. 8 and the heat ansfer pipes 2 illustrated in FIG. 5, for example.

The heat exchanger 500 further includes, for example, a windward header collecting pipe 503, a leeward header collecting pipe 504, and a unit joint member 505, in addition to the windward heat exchanger unit 500A and the leeward heat exchanger unit 500B.

(Operation of Heat Exchanger 500)

Figure 11:
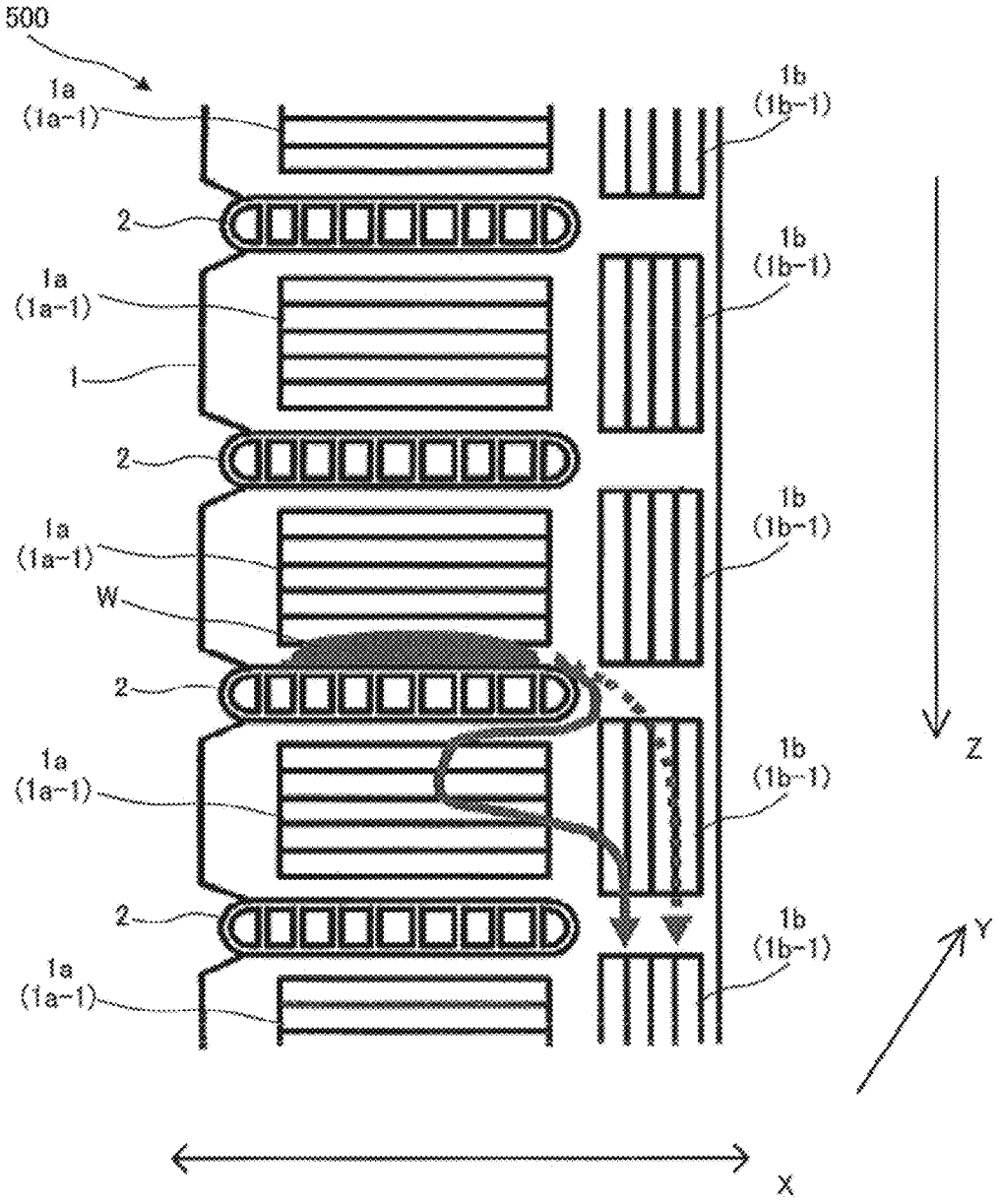
FIG. 11 is a schematic view illustrating flows of water generated in the finned tube heat exchanger according to Embodiment 1 of the invention.

FIG. 11 is a schematic view illustrating flows of water generated in the heat exchanger 500. The operation of the heat exchanger 500 will now be explained with reference to FIG. 11. In FIG. 11, the water generated in the heat exchanger 500 is indicated as a water drop W. The heat exchanger 500 illustrated in FIG. 11 has corrugated water guiding structures 1*a*-1 as water guiding structures and has corrugated water drainage structures 1*b*-1 as water drainage structures.

First, heat exchange between air supplied from an air-sending unit and refrigerant flowing in the heat transfer pipes 2 will be explained.

The air-sending unit includes, for example, a propeller fan, a motor, and a controller. The air-sending unit is disposed upstream or downstream of the heat exchanger 500 such that the rotational axis of the propeller fan is substantially horizontal. The air flow direction may extend from the side of the water guiding area 1*a* to the inside of the heat exchanger 500 or extend from the side of the water drainage area 1*b* to the inside of the heat exchanger 500.

Air flows from the side of the water guiding area 1*a* or the side of the water drainage area 1*b* into gaps between the fins 1. The air that has entered from the side of the water guiding area 1*a* flows out through the side of the water drainage area 1*b*. In contrast, the air that has entered from the side of the water drainage area 1*b* flows out through the side of the water guiding area 1*a*. In both cases, the air that has reached the front edge of the heat transfer pipe 2 split into two ways, that is, the way along the upper surface 2*a* and the way along the lower surface 2*c*. In the case where the air enters from the side of the water guiding area 1*a*, the first side 2*d* corresponds to the front edge of the heat transfer pipe 2. In contrast, in the case where the air enters from the side of the water drainage area 1*b*, the second side 2*b* corresponds to the front edge of the heat transfer pipe 2.

The air flow along the upper surface 2*a* will be explained. Since the upper surface 2*a* is parallel to the air flow direction, air can flow along the upper surface 2*a* across substantially the entire heat transfer pipe 2 in the width direction without significant separation. This configuration can facilitate heat exchange between the air and the surface of the heat transfer pipe 2. The configuration can also reduce the ventilation resistance.

The air flow along the lower surface 2*c* will be explained.

Since the lower surface 2*c* is also parallel to the air flow direction, air can flow along the lower surface 2*c* across substantially the entire heat transfer pipe 2 in the width direction without significant separation. This configuration can facilitate heat exchange between the air and the surface of the heat transfer pipe 2. The configuration can also reduce the ventilation resistance.

Second, a process of draining off water drops adhering to the water guiding area 1*a* in the heat exchanger 500 will be explained.

For example, when the heat exchanger 500 functions as an evaporator, condensed water is generated in the heat exchanger 500. The condensed water forms a water drop W and adheres to the water guiding area 1*a* of the fin 1. The water drop W adhering to the water guiding area 1*a* flows downward in the water guiding area 1*a*. The water drop W that has flown downward in the water guiding area 1*a* then arrives at the upper surface 2*a* of the heat transfer pipe 2 disposed below the water guiding area 1*a*.

The water drop W that has arrived at the upper surface 2*a* of the heat transfer pipe 2 remains on the upper surface 2*a* of the heat transfer pipe 2 and becomes larger. When the water drop W becomes a predetermined size or larger, the water drop W is guided toward the second side 2*b* and the first side 2*d* due to the shape of the heat transfer pipe 2, The water drop W that has flown to the second side 2*b* and reached the water drainage area 1*b* then flows in the water drainage area 1*b* and is drained off to the lower portion of the heat exchanger 500. The water drop W flows on the surface of the fin 1 to the lower portion of the heat exchanger 500 and is drained off without stopping, because the water drainage area 1*b* includes no heat transfer pipe 2.

The water drop W that has not flown from the water guiding area 1*a* to the water drainage area 1*b* flows along the second side 2*b* and the first side 2*d* of the heat transfer pipe 2 to the lower surface 2*c*. The water drop W that has flown to the lower surface 2*c* of the heat transfer pipe 2 remains on the lower surface 2*c* of the heat transfer pipe 2 and becomes larger, while the surface tension, gravitational force, static frictional force, and other forces are balanced. The water drop W expands downward with the growth and becomes more susceptible to the gravitational force. When the gravitational force on the water drop W exceeds the component of the forces including surface tension in the direction opposite to the gravity direction (indicated by arrow Z), then the water drop W becomes not affected by the surface tension and leaves the lower surface 2*c* of the heat transfer pipe 2 to fall down.

The water drop W that has left the lower surface 2*c* of the heat transfer pipe 2 flows downward in the water guiding area 1*a* again and arrives at the upper surface 2*a* of the lower heat transfer pipe 2. Alternatively, the water drop W that has left the lower surface 2*c* of the heat transfer pipe 2 flows to the second side 2*b*, is guided by the water drainage area 1*b*, flows in the water drainage area 1*b*, and is then drained off to the lower portion of the heat exchanger 500. That is, the water drop W repeats similar behaviors while traveling from the top to the bottom and is finally drained off to the lower portion of the heat exchanger 500.

In the heat exchanger 500, the water guiding area 1*a* has "water guiding structures" and the water drainage area 1*b* has "water drainage structures". These structures can facilitate traveling of the water drop W adhering to the water guiding area 1*a* to the side of the water drainage area 1*b*, thereby improving the drainage performance. Specifically, the water drop W adhering to the water guiding area 1*a* flows in the direction of the ridge lines of the corrugated water guiding structures and thus readily arrives at the water drainage area 1*b*.

As explained above, the heat exchanger 500, in which the water guiding area 1*a* has "water guiding structures" and the water drainage area 1*b* has "water drainage structures", can provide improved drainage performance. This configuration can suppress air passages from being blocked by frozen water, for example, in the heat exchanger 500 and thus significantly suppress a reduction in heat transfer performance. Further, in this heat exchanger 500, since the water guiding area 1*a* has "water guiding structures" and the water drainage area 1*b* has "water drainage structures", the water guiding area 1*a* and the water drainage area 1*b* have increased surface areas. This configuration can improve the heat transfer performance.

Although the heat transfer pipe 2 according to Embodiment 1 has a flat shape having a larger width than height, this shape should not be construed as limiting the scope of the invention. The heat transfer pipe 2 may also be a circular pipe. In addition, although the illustrated heat exchanger is equipped with fins 1, this configuration should not be construed as limiting the scope of the invention. Alternatively, the heat exchanger may be equipped with a single fin 1.

Embodiment 2

Figure 12:
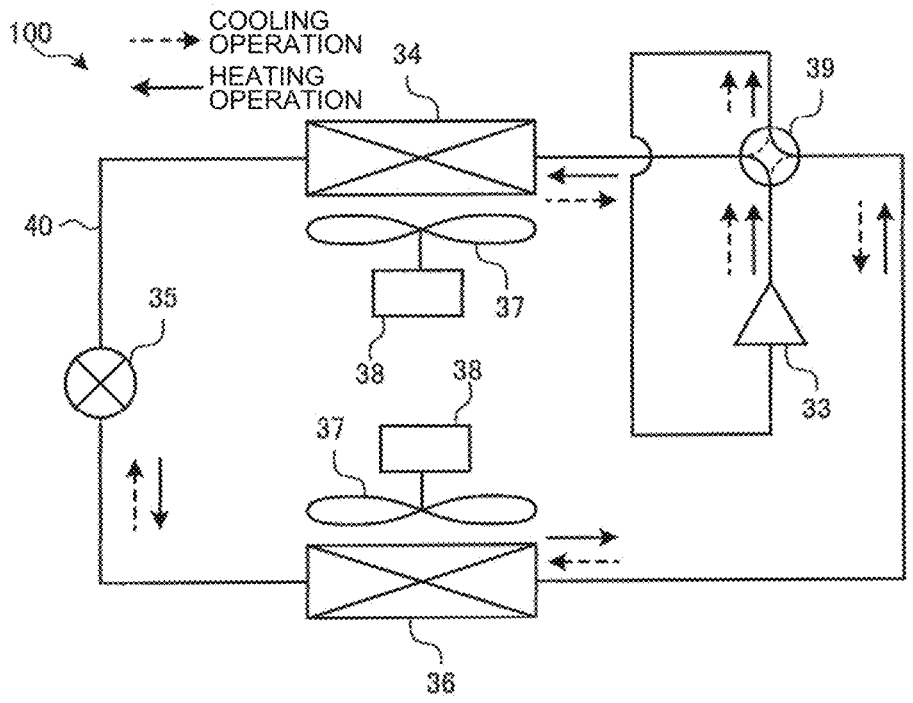
FIG. 12 is a schematic circuit diagram illustrating an exemplary configuration of a refrigerant circuit of a refrigeration cycle apparatus according to Embodiment 2 of the invention.

FIG. 12 is a schematic circuit diagram illustrating an exemplary configuration of a refrigerant circuit of a refrigeration cycle apparatus 100 according to Embodiment 2 of the invention. The refrigeration cycle apparatus 100 will now be described with reference to FIG. 12. The description of Embodiment 2 focuses on the differences from Embodiment 1. The components identical to those in Embodiment 1 are provided with the same reference symbol without redundant description. FIG. 12 illustrates an air-conditioning apparatus as an example of the refrigeration cycle apparatus 100. In FIG. 12, the dashed arrows indicate the refrigerant flow during a cooling operation and the solid arrows indicate the refrigerant flow during a heating operation.

With reference to FIG. 12, the refrigeration cycle apparatus 100 includes a compressor 33, a flow switching device 39, a first heat exchanger 34, an expansion device 35, a second heat exchanger 36, and air-sending devices 37. The compressor 33, the first heat exchanger 34, the expansion device 35, and the second heat exchanger 36 are connected to each other with a refrigerant pipe 40 to configure a refrigerant circuit. The individual air-sending devices 37 are provided for the first heat exchanger 34 and the second heat exchanger 36 to supply air to the first heat exchanger 34 and the second heat exchanger 36. Each of the air-sending devices 37 are rotated by an air-sending device motor 38.

The compressor 33 compresses refrigerant. The refrigerant compressed by the compressor 33 is discharged to the first heat exchanger 34. The compressor 33 is composed of, for example, a rotary compressor, a scroll compressor, a screw compressor, or a reciprocating compressor.

The first heat exchanger 34 functions as a condenser during the heating operation and functions as an evaporator during the cooling operation. Specifically, the first heat exchanger 34 functioning as a condenser causes heat exchange between high-temperature, high-pressure refrigerant discharged from the compressor 33 and air supplied from the air-sending device 37, resulting in condensation of the high-temperature, high-pressure gas refrigerant. In contrast, the first heat exchanger 34 functioning as an evaporator causes heat exchange between low-temperature, low-pressure refrigerant flowing from the expansion device 35 and air supplied from the air-sending device 37, resulting in evaporation of the low-temperature, low-pressure liquid refrigerant or two-phase refrigerant.

The expansion device 35 expands and decompresses refrigerant flowing from the first heat exchanger 34 or the second heat exchanger 36. The expansion device 35 should preferably be composed of, for example, an electric expansion valve that can adjust the flow rate of refrigerant. Alternatively, the expansion device 35 may be composed of, for example, a mechanical expansion valve including a diaphragm in a pressure sensing portion or a capillary tube, other than the electric expansion valve.

The second heat exchanger 36 functions as an evaporator during the heating operation and functions as a condenser during the cooling operation. Specifically, the second heat exchanger 36 functioning as an evaporator causes heat exchange between low-temperature, low-pressure refrigerant flowing from the expansion device 35 and air supplied from the air-sending device 37, resulting in evaporation of the low-temperature, low-pressure liquid refrigerant or two-phase refrigerant. In contrast, the second heat exchanger 36 functioning as a condenser causes heat exchange between high-temperature, high-pressure refrigerant discharged from the compressor 33 and air supplied from the air-sending device 37, resulting in condensation of the high-temperature, high-pressure gas refrigerant.

The flow switching device 39 switches the refrigerant flow between the heating operation and the cooling operation. Specifically, during the heating operation, the flow switching device 39 switches the refrigerant flow to connect the compressor 33 to the first heat exchanger 34. In contrast, during the cooling operation, the flow switching device 39 switches the refrigerant flow to connect the compressor to the second heat exchanger 36. The flow switching device 39 should preferably be composed of, for example, a four-way valve. Alternatively, the flow switching device 39 may be composed of a combination of two-way valves or three-way valves.

The heat exchanger 500 according to Embodiment 1 may be applied to either one or both of the first heat exchanger 34 and the second heat exchanger 36. In other words, the refrigeration cycle apparatus 100 is equipped with the heat exchanger 500 according to Embodiment 1 as at least one of the first heat exchanger 34 and the second heat exchanger 36. It is preferable that the heat exchanger 500 be used as the second heat exchanger 36, as described in Embodiment 1.

<Operations of Refrigeration Cycle Apparatus 100>

The operations of the refrigeration cycle apparatus 100 and the refrigerant flow will now be explained. The operations of the refrigeration cycle apparatus 100 are made taking as an example a case in which the fluid that performs heat exchange is air and the fluid that is subject to heat exchange is refrigerant.

First, the cooling operation executed by the refrigeration cycle apparatus 100 will now be explained. The refrigerant flow during the cooling operation is indicated by the dashed arrows in FIG. 12.

As illustrated in FIG. 12, the compressor 33 is driven and thus discharges high-temperature, high-pressure gas refrigerant. The refrigerant then flows in accordance with the dashed arrows. The high-temperature, high-pressure gas refrigerant (single phase) discharged from the compressor 33 flows through the flow switching device 39 into the second heat exchanger 36 functioning as a condenser. The second heat exchanger 36 causes heat exchange between this high-temperature, high-pressure gas refrigerant and air supplied from the air-sending device 37, so that the high-temperature, high-pressure gas refrigerant condenses into high-pressure liquid refrigerant (single phase).

The high-pressure liquid refrigerant output from the second heat exchanger 36 is converted into two-phase refrigerant containing low-pressure gas refrigerant and liquid refrigerant by the expansion device 35. This two-phase refrigerant flows into the first heat exchanger 34 functioning as an evaporator. The first heat exchanger 34 causes heat exchange between this two-phase refrigerant and air supplied from the air-sending device 37, so that the liquid refrigerant contained in the two-phase refrigerant evaporates, resulting in low-pressure gas refrigerant (single phase). The low-pressure gas refrigerant output from the first heat exchanger 34 flows through the flow switching device 39 into the compressor 33. The compressor 33 compresses this low-pressure gas refrigerant into high-temperature, high-pressure gas refrigerant and discharges the resulting gas refrigerant again. This operation will be repeated thereafter.

Next, the heating operation executed by the refrigeration cycle apparatus 100 will now be explained. The refrigerant flow during the heating operation is indicated by the solid arrows in FIG. 12.

As illustrated in FIG. 12, the compressor 33 is driven and thus discharges high-temperature, high-pressure gas refrigerant. The refrigerant then flows in accordance with the solid arrows. The high-temperature, high-pressure gas refrigerant (single phase) discharged from the compressor 33 flows through the flow switching device 39 into the first heat exchanger 34 functioning as a condenser. The first heat exchanger 34 causes heat exchange between this high-temperature, high-pressure gas refrigerant and air supplied from the air-sending device 37, so that the high-temperature, high-pressure gas refrigerant condenses into high-pressure liquid refrigerant (single phase).

The high-pressure liquid refrigerant output from the first heat exchanger 34 is converted into two-phase refrigerant containing low-pressure gas refrigerant and liquid refrigerant by the expansion device 35. This two-phase refrigerant flows into the second heat exchanger 36 functioning as an evaporator. The second heat exchanger 36 causes heat exchange between this two-phase refrigerant and air supplied from the air-sending device 37, so that the liquid refrigerant contained in the two-phase refrigerant evaporates, resulting in low-pressure gas refrigerant (single phase). The low-pressure gas refrigerant output from the second heat exchanger 36 flows through the flow switching device 39 into the compressor 33. The compressor 33 compresses this low-pressure gas refrigerant into high-temperature, high-pressure gas refrigerant and discharges the resulting gas refrigerant again. This operation will be repeated thereafter.

During the heating operation of the refrigeration cycle apparatus 100, the second heat exchanger 36 functions as an evaporator. Accordingly, during the heat exchange in the second heat exchanger 36 between air supplied from the air-sending device 37 and refrigerant flowing in the heat transfer pipes included in the second heat exchanger 36, the water in the air condenses into water drops on the surface of the second heat exchanger 36. The water drops generated in the second heat exchanger 36 flow downward through drainage passages (the water drainage area 1*b* described in Embodiment 1) defined by the fins and the heat transfer pipes and are drained off.

For example, in the case where the second heat exchanger 36 is accommodated in an outdoor unit (not shown) of the refrigeration cycle apparatus 100 and functions as an evaporator during the heating operation of the refrigeration cycle apparatus 100, the water in the air may form frost in the second heat exchanger 36. To solve this problem, a typical air-conditioning apparatus, for example, capable of heating operation executes a "defrosting operation" for removing the frost at an outside air temperature equal to or lower than a predetermined temperature (for example, 0 degrees C.).

The "defrosting operation" indicates an operation of supplying hot gas (high-temperature, high-pressure gas refrigerant) from the compressor 33 to the second heat exchanger 36 functioning as an evaporator, to suppress frost formation in the second heat exchanger 36. Alternatively, the defrosting operation may be executed if the duration of the heating operation reaches a predetermined time (for example, 30 minutes). Alternatively, the defrosting operation may be executed in advance of the heating operation if the temperature of the second heat exchanger 36 is equal to or lower than a predetermined temperature (for example, −6 degrees C.). The frost and ice adhering to the second heat exchanger 36 are melted by the hot gas supplied to the second heat exchanger 36 during the defrosting operation.

The following explanation focuses on the case where the heat exchanger 500 according to Embodiment 1 is applied to the second heat exchanger 36. Although the direction of air flowing into the heat exchanger 500 is not particularly limited in Embodiment 1, the explanation of Embodiment 2 assumes that air flows from the side of the water guiding area 1*a* to the side of the water drainage area 1*b* in the heat exchanger 500. That is, air flows from the left to the right in FIG. 9. The air-sending device 37 may be disposed upstream or downstream of the heat exchanger 500.

As described in Embodiment 1, the heat exchanger 500 has the water guiding area 1*a* having "water guiding structures" and the water drainage area 1*b* having "water drainage structures". This configuration can cause water drops adhering to the fin 1 to readily travel from the water guiding area 1*a* to the water drainage area 1*b* in the second heat exchanger 36. In addition, the air flow from the side of the water guiding area 1*a* to the side of the water drainage area 1*b* can further facilitate the traveling of the water drops adhering to the fin 1. The water drops are subject to the same operations a larger number of times as the water drops approach the bottom of the fin 1 in the gravity direction. Accordingly, more of the water drop W adhering to the water guiding area 1*a* is guided to the water drainage area 1*b* as the water drop W approaches the bottom of the fin 1 in the gravity direction.

This configuration leads to a reduction in the water remaining in the entire second heat exchanger 36. As explained above, the refrigeration cycle apparatus 100 equipped with the heat exchanger 500 according to Embodiment 1 as the second heat exchanger 36 provides significantly improved performance of draining off water drops generated in the second heat exchanger 36.

In addition, immediately after the start of melting the frost adhering to the second heat exchanger 36 during the defrosting operation, a lot of water drops are drained off from the second heat exchanger 36. The refrigeration cycle apparatus 100 thus requires a shorter defrosting period of the defrosting operation. A reduction in the amount of heat for the defrosting operation and a reduction in the defrosting period lead to an improvement in the efficiency of the refrigeration cycle apparatus 100. Furthermore, the refrigeration cycle apparatus 100 can reduce the water remaining during the heating operation, thereby improving the reliability, reducing the ventilation resistance, and increasing the frost resistance.

The refrigerant used in the refrigeration cycle apparatus 100 is not particularly limited. Other types of refrigerant, such as R410A, R32, and HFO1234yf, may also be used to bring about the same effects.

Although the working fluids are air and refrigerant in the above embodiments, this example should not be construed as limiting the scope of the invention. The working fluids may be replaced with another gas, liquid, or gas-liquid mixed fluid to bring about the same effects. In other words, the working fluids may be selected in accordance with the usage of the refrigeration cycle apparatus 100 and any working fluid leads to the same effects.

The same effects can be brought about by the configuration in which the heat exchanger 500 is applied to the first heat exchanger 34.

The refrigeration cycle apparatus 100 may use any refrigerating machine oil, such as a mineral oil, an alkylbenzene oil, an ester oil, an ethereal oil, or a fluorine oil, regardless of the solubility of the oil to the refrigerant. Any refrigerating machine oil leads to the same effects of the heat exchanger 500.

Other examples of refrigeration cycle apparatus 100 include a water heater, a freezer, and an air-conditioning water heater. Any of these apparatuses can be readily fabricated and has improved heat exchange performance and improved energy efficiency.

As described above, the refrigeration cycle apparatus 100 is equipped with a refrigerant circuit including the compressor 33, the first heat exchanger 34, the expansion device 35, and the second heat exchanger 36, and includes the heat exchanger 500 according to Embodiment 1 as at least one of the first heat exchanger 34 and the second heat exchanger 36. The refrigeration cycle apparatus 100 thus has improved drainage performance and sufficient heat transfer performance at the same time.

REFERENCE SIGNS LIST

1 fin 1*a* water guiding area 1*a*-1 corrugated water guiding structure 1*a*-2 dimpled water guiding structure 1*a*-3 slit water guiding structure 1*a*-4 diagonal corrugated water guiding structure 1*b* water drainage area 1*b*-1 corrugated water drainage structure 1*b*-2 dimpled water drainage structure 1*b*-3 slit water drainage structure 2 heat transfer pipe 2A partition 2*a* upper surface 2*b* second side 2*c* lower surface 2*d* first side 10 notch 10*a* innermost end 10*b* insertion part 20 refrigerant passage 33 compressor 34 first heat exchanger 35 expansion device 36 second heat exchanger 37 air-sending device 38 air-sending device motor 39 flow switching device 40 refrigerant pipe 100 refrigeration cycle apparatus 500 heat exchanger 500A windward heat exchanger unit 500B leeward heat exchanger unit 503 windward header collecting pipe 504 leeward header collecting pipe 505 unit joint member W water drop X air flow direction Y fin array direction Z gravity direction

The invention claimed is:

1. A heat exchanger comprising:

a fin extending in a gravity direction; and heat transfer pipes installed so as to intersect the fin, the heat transfer pipes being arranged in the gravity direction, wherein the fin has a water guiding area disposed above and below each of the heat transfer pipes, and a water drainage area disposed adjacent to a side of each of the heat transfer pipes, the water guiding area has water guiding structures for guiding water to the water drainage area, and the water drainage area has water drainage structures for guiding water in the gravity direction, wherein the water guiding structures are provided by forming a part of the fin in dimples, the water drainage structures are provided by forming a part of the fin in dimples, and the dimples of the water guiding structures and the dimples of the water drainage structures are arranged at different densities.

2. The heat exchanger of claim 1, wherein the water guiding structures have slits provided by cutting and raising portions of the fin.

3. The heat exchanger of claim 1, wherein the water drainage structures have slits provided by cutting and raising portions of the fin.

4. The heat exchanger of claim 1, wherein each of the heat transfer pipes has a longitudinal axis longer than a transverse axis in a sectional view.

5. The heat exchanger of claim 4, wherein the longitudinal axis in the sectional view of each of the heat transfer pipes is angled downward toward the water drainage area.

6. The heat exchanger of claim 5, wherein each of the heat transfer pipes is angled at an angle of 20 degrees or less.

7. A refrigeration cycle apparatus comprising:

a refrigerant circuit including a compressor, a first heat exchanger, an expansion device, and a second heat exchanger connected to each other with a refrigerant pipe, wherein at least one of the first heat exchanger and the second heat exchanger is composed of the heat exchanger of claim 1.

8. The refrigeration cycle apparatus of claim 7, wherein the second heat exchanger is composed of the heat exchanger of claim 1, the refrigeration cycle apparatus further comprises an air-sending device for supplying air to the second heat exchanger, and the air supplied by the air-sending device flows from a side of the water guiding area of the second heat exchanger.

* * * * *